US006824482B1

(12) United States Patent
Tribble

(10) Patent No.: US 6,824,482 B1
(45) Date of Patent: Nov. 30, 2004

(54) METAL/WOOD BAT CONNECTION ASSEMBLY

(75) Inventor: James G. Tribble, Winfield, WV (US)

(73) Assignee: West Virginia Bats, LLC, Eleanor, WV (US)

( * ) Notice: Subject to any disclaimer, the term of this patent is extended or adjusted under 35 U.S.C. 154(b) by 0 days.

(21) Appl. No.: 10/600,254

(22) Filed: Jun. 20, 2003

Related U.S. Application Data

(62) Division of application No. 10/053,793, filed on Jan. 18, 2002, now Pat. No. 6,758,771.

(60) Provisional application No. 60/281,098, filed on Apr. 3, 2001, and provisional application No. 60/262,564, filed on Jan. 18, 2001.

(51) Int. Cl.[7] ..... A63B 59/06

(52) U.S. Cl. ..... 473/564; 473/566

(58) Field of Search ..... 473/564–568, 473/519, 520, 457

(56) References Cited

U.S. PATENT DOCUMENTS

| | | | | |
|---|---|---|---|---|
| 1,509,733 | A | 9/1924 | Langford | |
| 2,195,681 | A | 4/1940 | Robarge | 273/72 |
| 3,779,551 | A | 12/1973 | Wilson | 273/72 |
| 3,877,698 | A | 4/1975 | Volpe | 273/72 R |
| 4,000,895 | A | 1/1977 | Scott, Jr. et al. | 273/72 |
| 4,213,607 | A | 7/1980 | Fujii | 273/72 |
| 4,714,251 | A | 12/1987 | Cook | 273/72 R |
| 4,720,104 | A | 1/1988 | DiSieno | 273/67 R |
| 5,409,214 | A | 4/1995 | Cook | 273/72 R |
| 5,593,158 | A | 1/1997 | Filice et al. | 473/520 |
| 5,695,416 | A | 12/1997 | Christian | 473/562 |
| 6,045,467 | A | 4/2000 | Anderson | 473/568 |
| 6,432,006 | B1 | 8/2002 | Tribble | 473/564 |

OTHER PUBLICATIONS

Excerpts of "www.eastonsports.com" and "www.baseballexp.com" websites (6 pages).

*Primary Examiner*—Mark S. Graham
(74) *Attorney, Agent, or Firm*—Steptoe & Johnson PLLC

(57) ABSTRACT

A bat is disclosed having a metal handle portion with a knob end and a barrel receiving end, a wood barrel portion with a hitting portion and a fitting portion, and a connection assembly for joining the wood barrel portion with the metal handle portion, the connection assembly having optionally three components: an exterior sleeve, an interior sleeve, and/or a locking or roll pin. The interior sleeve is positioned over a fitting portion of the wood barrel portion prior to the fitting portion being inserted and pressure fit within a barrel receiving end of the metal handle portion. A hole is drilled through the barrel receiving end and the fitting portion of the wood barrel portion, wherein a locking or roll pin is inserted through and secured in the hole to lock the metal handle portion with the wood barrel portion.

26 Claims, 4 Drawing Sheets

METAL/WOOD BAT CONNECTION ASSEMBLY

CROSS-REFERENCE TO RELATED APPLICATIONS

This application claims the benefit of U.S. Application No. 60/262,564, filed Jan. 18, 2001 and U.S. Application No. 60/281,098, filed Apr. 3, 2001 which is a divisional of Ser. No. 10/053,793 filed Jan. 18, 2002 now U.S. Pat. No. 6,758,771.

BACKGROUND OF THE INVENTION

1. Field of the Invention

This invention relates to bats, and in particular, to a baseball and softball bats having a wood barrel portion and a metal handle portion with a new and improved means for connecting the wood barrel portion to the metal handle portion.

2. Related Art

There are two dominate types of bats used in both softball and baseball—aluminum and wood. Although most school leagues allow players to use either type of bat, the Little League organization and the Major League only allow players to use wooden bats and this is for safety reasons. It is well known that players can hit a ball harder and longer with the lighter aluminum bats. Therefore, these two organizations recognize the principal safety factor associated with using wooden bats; that is, slower ball speed coming off of the bat.

However, wood bats also have a safety issue in that the handle portion of a wood bat tends to break above the players grip. This is an important concern because upon a wood bat breaking, the top barrel, or hitting, portion often becomes a projectile which may hit and injure another player or an innocent bystander. For example, testing has shown that a conventional Little League wood bat breaks, i.e., snaps at the handle, when the bat's swinging speed reaches about 72–75 mph. This breakage is due to the fact that the wood does not "give" to the torque on the bat during a high powered swing. In contrast, conventional aluminum bats do not break at the handle. The principal safety issue regarding aluminum bats is the ball speed coming off of the bat.

Therefore, there is a need for a bat that combines the wooden barrel portion of a conventional wood bat with the metal handle portion of a conventional aluminum bat in order to take advantage of both types of bats: the safety of a wood barrel with the strength of a metal handle. There is a further need for a metal/wood bat that does not break during normal usage. There is still a further need for a metal/wood bat that ensures that the two portions of the bat do not separate during use or upon the infrequent breaking of the bat.

It also is well appreciated that baseball players have a difficult time making the transition from using an aluminum bat to a wood bat. The aluminum bats have a larger "sweet" spot on the barrel, thereby making it easier for a player to get a good hit. In contrast, wood bats have a smaller "sweet" spot on the barrel, thereby requiring a player to have better eye-hand coordination to get a good hit. Therefore, despite a player's success and good batting statistics using aluminum bats, the player may not have the same level of success upon changing over to wood bats.

In U.S. Pat. No. 5,409,214 to Cook, a bat is disclosed having a handle part formed of metal and a hitting part formed of one, two or more pieces of wood connected by finger joints. Specifically, the bat comprises a hitting member that may be a single piece of wood. The hitting member is defined as having a barrel end and a handle end wherein the handle end terminates about 1–2 inches from the knob. Therefore, in essence, the wood portion of the Cook bat is about as long as a conventional wood bat. The bat is constructed by using an adhesive to secure the metal portion over the handle end of the wood portion (hitting member). In fact, the metal handle of Cook does not replace the wood handle of a conventional wood bat, but rather, the Cook handle merely reinforces the wood handle of the wood hitting member.

Although the Cook bat appears to disclose a metal/wood bat, there are many disadvantages with the Cook bat that make it impractical to use. First, the metal handle part simply covers, or reinforces, the handle end of the wood hitting member. No matter how close the wood handle is fit within the metal handle, a vibration will occur when a player hits a ball, thereby interfering with the player's grip on the bat. Secondly, the vibration upon hitting a ball will have a damaging effect on the adhesive connection between the wood handle part and the metal handle part. The metal and wood parts of the bat are only secured together by an adhesive and once the adhesive breaks down, the two parts will separate. Therefore, the vibration resulting from hitting a ball will break down that adhesive connection. Then, upon hitting one more ball, the two pieces will separate resulting in the wooden hitting member becoming a projectile, as with a conventional wood bat, and possibly hurting someone.

Therefore, there is a need for a metal/wood bat wherein only the barrel portion of the bat is made of wood and the handle portion of the bat is only made of metal such that all vibrational shock resulting from hitting a ball is eliminated. There is a further need for a metal/wood bat wherein the wood barrel portion cannot separate from the metal handle portion, thereby eliminating all possibility of the wood barrel portion becoming a dangerous projectile. There is still a further need for a metal/wood bat that does not require the use of an adhesive.

Currently, there is a metal/wood bat commercially available that is comprised of a wood hitting portion and a metal handle portion wherein the wood hitting portion does not extend through the substantial length of the metal handle. This metal/wood bat is disclosed in U.S. Application No. 60/112,160 (filed Dec. 14, 1998), Ser. No. 09/460,736 (filed Dec. 14, 1999), and PCT Application No. PCT/US99/29624 (filed Dec. 14, 1999) (collectively, "the '736 bat"). The preferred connection assembly for this '736 bat is a metal rod that is anchored at an end of the wood barrel portion, extends the entire length of the metal handle portion, and terminates at and through the knob, thereby securing the wood barrel portion to the knob end of the handle.

There are several disadvantages to the connection assembly of the '736 bat. The manufacturing and assembly of the '736 bat is complex and time consuming. Second, the rod adds extra weight and cost to the bat. Therefore, there is a need for a metal/wood bat that has a simpler connection assembly for securing a wood barrel portion to a metal handle portion, resulting in a less expense bat that requires less time to assemble—yet retains a secure connection of the wood hitting portion to the metal handle portion.

SUMMARY OF THE INVENTION

The connection assembly of the present invention solves the problems associated with conventional methods for manufacturing a metal/wood bat, and in particular, for solving the problems with the methods for joining a metal handle portion with a wood barrel portion. In the preferred embodiment, the connection assembly optionally comprises three components: an exterior sleeve, an interior sleeve, and/or a pin assembly.

The interior sleeve is positioned over a fitting portion of the wood barrel portion prior to the fitting portion being inserted and pressure fit within a barrel receiving end of the metal handle portion. A hole is drilled through the barrel receiving end and the fitting portion of the wood barrel portion, wherein a pin assembly locks the metal handle portion with the wood barrel portion. The pin assembly is either a locking or a roll pin inserted through and secured in the hole. Once the two portions of the bat are joined, an exterior sleeve is used to smooth the seam between the metal handle portion and the wood barrel portion.

There are several advantages with using the pin assembly of this new connection assembly over the prior art. First, the present invention reduces the total weight of a bat by about two to four ounces, e.g., three ounces. This weight reduction is due to the fact that the metal rod of the prior '736 bat is eliminated. Second, all twisting or turning of the wood barrel portion within the metal handle portion is eliminated. Third, the use of a locking or roll pin secured within a hole to lock the wood barrel portion to the metal handle portion also eliminates the need for a conventional adhesive and provides a very inexpensive, quick and efficient way to manufacture the bat. Fourth, the new preferred thickness of the metal handle portion is about ⅛th of an inch, resulting in a much stronger handle.

The use of an interior and exterior sleeve of the present invention also provides several advantages. First, the interior sleeve is made from a tacky gum rubber to provide additional friction. The interior sleeve eliminates the need for a conventional adhesive to secure the fitting portion of the wood barrel portion within the metal handle portion. The natural inherent features of the interior sleeve assures that the wood barrel portion does not separate from the metal handle portion. Second, the exterior sleeve provides a more stable and secure connection such that when a player hits a ball at or around the seam between the metal handle portion and the wood barrel portion, the batter does not experience much, if any, vibration in the metal handle portion, the ball coming off the bat most likely flies true, and the wood barrel portion will not crack, splinter or break.

DESCRIPTION OF THE FIGURES

The present invention is described with reference to the accompanying drawings. In the drawings, like reference numbers indicate identical or functionally similar elements. Additionally, the left-most digit(s) of a reference number identifies the drawings in which the reference number first appears.

DETAILED DESCRIPTION OF THE PREFERRED EMBODIMENTS

Figure 1:
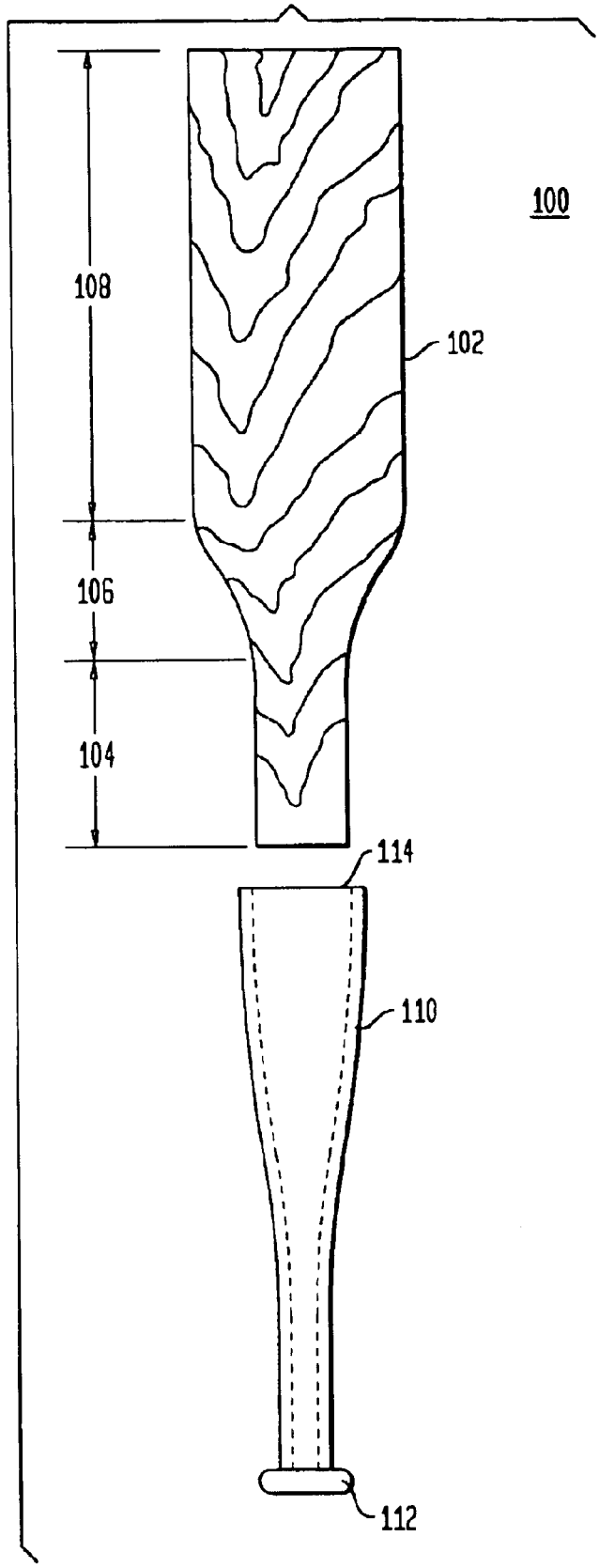
FIG. 1: A planar side view of a wood barrel portion of a bat of the present invention.
Figure 2:
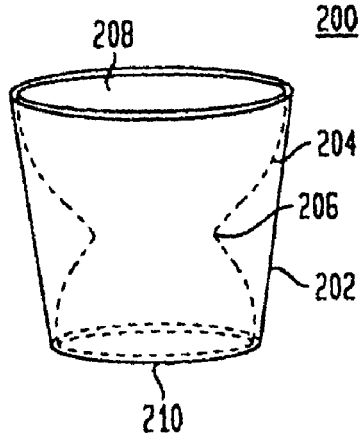
FIG. 2: A perspective view of an exterior barrel sleeve.
Figure 3:
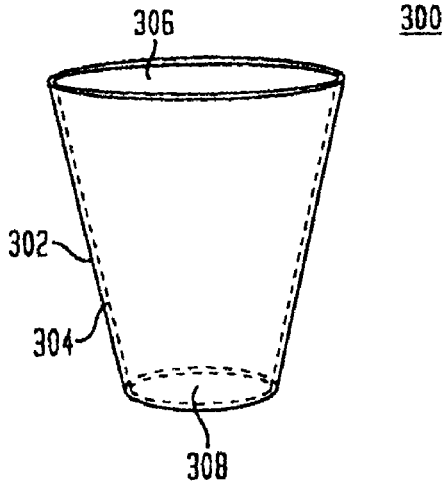
FIG. 3: A perspective view of an interior barrel sleeve.

The connection assembly for a bat 100 of the present invention is shown in FIGS. 1–6. The bat 100 comprises a wood barrel portion 102 and a metal handle portion 110. The wood barrel portion 102 is designed and manufactured according to conventional wood bat methods. In the preferred embodiment, the metal handle portion 110 is a hollow piece of metal, e.g., aluminum or graphite, manufactured using well known techniques, and having a barrel receiving end 114 and a knob end 112 at its distal end. The wood barrel portion 102 and the metal handle portion 110 are such that the total size, weight, and weight distribution of the bat 100 of the present invention are identical to those of conventional bats. Once the bat 100 is manufactured, a batter may place any conventional type of grip on the metal handle portion 110 for comfort and improvement of his/her batting.

In the preferred embodiment, the wood barrel portion 102 of the bat 100 has a hitting portion 108 and a fitting portion 104. The hitting portion 108 is the exposed area of the bat 100 for hitting a ball, and the fitting portion 104 is that part of the wood barrel portion 102 for interlocking with the metal handle portion 110. In the preferred embodiment, the fitting portion 104 tapers from a first diameter of about 1⅝ (1.625) inches to a second diameter of about 0.985 inches and is about 3 inches in length. The tapering diameter of the fitting portion 104 is recessed about ⅛ of an inch smaller than the diameter of the hitting portion 108 to ensure its fit within the metal handle portion 110. The taper of the fitting portion 104 is about equal to the angle of taper of the barrel receiving end 114 of the metal handle portion 110.

The connection assembly is used to secure the metal handle portion 110 of a bat 100 to the wood barrel portion 102 of the bat 100, wherein the fitting portion 104 of the wood barrel portion 102 fits and is secured within the barrel receiving end 114 of the metal handle portion 110. The connection assembly assures that the wood barrel portion 102 does not separate from the metal handle portion 110 as well as dampens any vibration that may result from the interconnection between a metal handle portion 110 and a wood barrel portion 102.

The hitting portion 108 of the wood barrel portion 102 is shaped as with a conventional wooden bat. The fitting portion 104 of the wood barrel portion 102 is a smaller tapered portion of the wood barrel portion 102 that is sized to fit within the barrel receiving end 114 of the metal handle portion 110. The transition 106 between the hitting portion 108 and the fitting portion 104 is a smooth taper, e.g., 45 degrees, that gradually and smoothly slopes from the diameter of the hitting portion 108 to the top of the fitting portion 104. The edges of the transition 106 are also smoothed and rounded.

In the preferred embodiment, the connection assembly of the present invention optionally comprises three components: an exterior sleeve 200, an interior sleeve 300, and/or a pin assembly, e.g., a locking pin 400 or a roll pin 600. The interior sleeve 300 is an elongated, cone shaped, rubber tube that tapers from a top opening 306 to a bottom opening 308 such that the diameter of the top opening 306 is larger than the diameter of the bottom opening 308. In the preferred embodiment, the interior sleeve 300 is about three inches in length and is made from about 1/16 of an inch thick rubber, e.g., 40 durometer gum rubber. A tacky, gum rubber is preferred because of its natural adhesion properties, thereby eliminating the need for an adhesive. The length, top opening 306 and bottom opening 308 of the interior sleeve 300 are sized such that the fitting portion 104 of the wood barrel portion 102 fits snuggly within the interior sleeve 300.

Once the interior sleeve 300 is placed over the fitting portion 104 of the wood barrel portion 102, the fitting portion 104 with the interior sleeve 300 is pressure fit within the barrel receiving end 114 of the metal handle portion 110, thereby creating a seam 502 between the wood barrel portion 102 and the metal handle portion 110. Preferably the fitting portion 104 is inserted into the barrel receiving end 114 such that the top opening 306 of the interior sleeve 300 is slightly below the seam 502.

A hole 504 is drilled through the metal handle portion 110, the interior sleeve 300 and the fitting portion 104 about one half of an inch below the seam 502. The hole 504 is traverse to the longitudinal axis of the bat 100 and preferably passes through the center of the bat 100.

Figure 4:
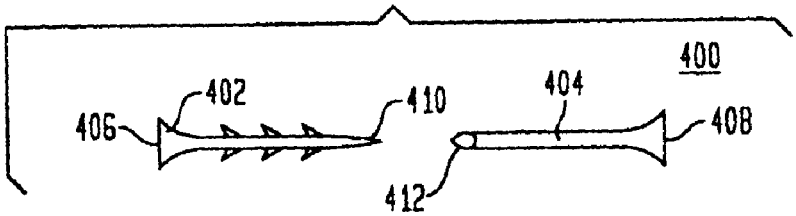
FIG. 4: A perspective view of a locking pin.
Figure 5:
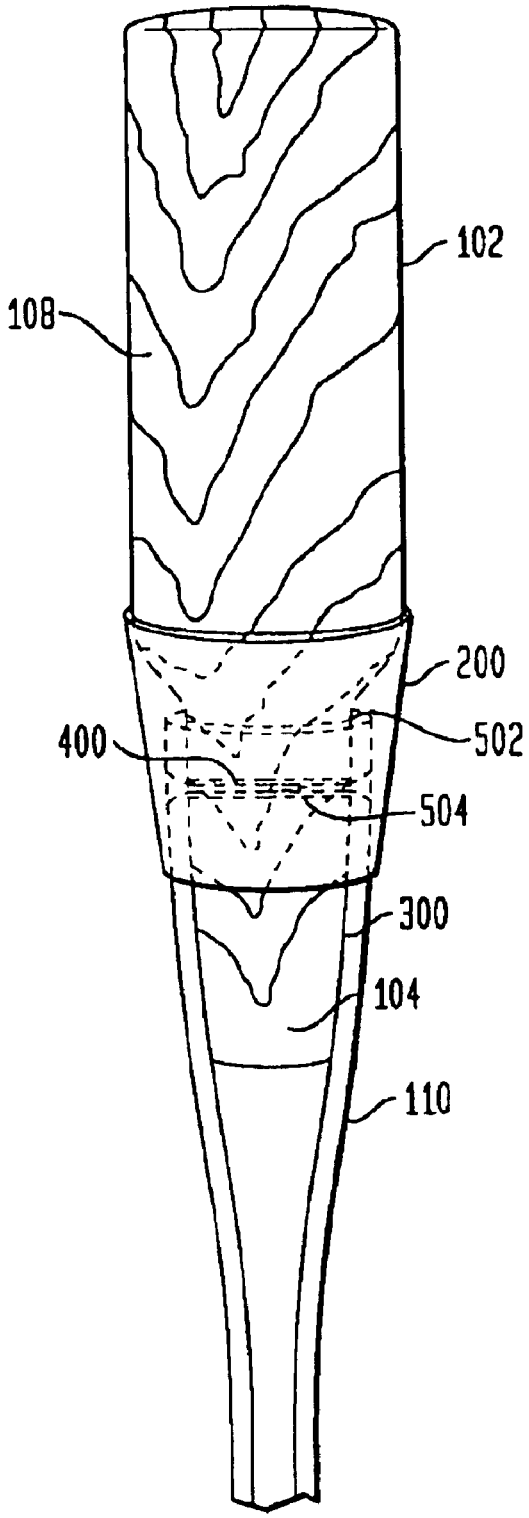
FIG. 5: A perspective view of a metal/wood bat of the present invention.
Figure 6:
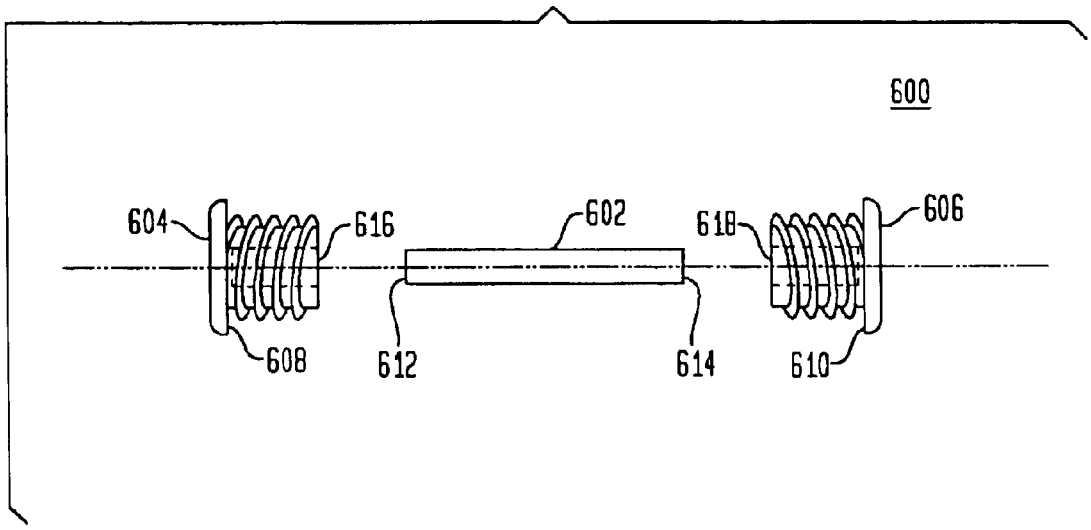
FIG. 6: A planar cross-sectional view of an alternative means for securing a metal handle portion to a wood barrel portion.

In one embodiment of a pin assembly, a locking pin 400 is used to secure the metal handle portion 110 to the wood barrel portion 102, passing through the metal handle portion 110, the interior sleeve 300, and the fitting portion 104 of the wood barrel portion 102. The preferred embodiment of the locking pin 400 is shown in FIG. 4, wherein the locking pin 400 is a commercially available stainless steel press fit pin, about ⅛ of an inch by about 1½ inches, having a male component 402 and a female component 404. In operation, the male component 402 is pressure fit, point end 410 first, into the opening 412 of the female component 404 such that they are locked together. The male component 402 is also preferably serrated in order to achieve a tighter and more secure lock within the female component 404. In addition, both the head end 406 of the male component 402 and the head end 408 of the female component 404 are flat surfaces that are wider in diameter than the shaft of the female component 404.

In operation, the female component 404 is inserted into one side of the hole 504 in the bat 100 until the head end 408 of the female component 404 is flush with, or approximately flush with, the exterior surface of the metal handle portion 110. The male component 402 is inserted into the opposite side of the hole 504 and pressure fit within the female component 404 until the head end 406 of the male component 402 is flush with, or approximately flush with, the exterior surface of the metal handle portion 110.

In an alternative pin assembly, another type of pin is used to lock the metal handle portion 110 to the wood barrel portion 102 of the bat 100. In this embodiment, a roll pin 602, about 5/32 of an inch in diameter and about the length of the hole 504, is inserted into the hole 504. Then, a threaded cap screw 604, 606, such as a ½ inch, flat, cap screw, is driven into each open end of the hole 504 such that each end 612, 614 of the roll pin 602 is driven into a cavity 616,618 of a threaded cap screw 604, 606, resulting in wedging the roll pin 602 into the hole 504 such that it cannot loosen, or otherwise fall out of the hole 504. A threaded cap screw 604, 606 is preferred because the threading on the exterior surface assists in preventing the threaded cap screws 604, 606 from falling out. Once the two threaded cap screws 604, 606 are in place, the heads 608, 610 of the threaded cap screws 604, 606 are grinded, or ground, off by conventional grinding means. The use of the two threaded cap screws 604, 606 to secure the roll pin 602 into the hole 504 acts the same as heat welding or tack welding the ends 612, 614 of the roll pin 602. The use of a roll pin 602 and threaded cap screws 604, 606 are for convenience purpose only. It would be readily apparent to one of ordinary skill in the relevant art to use a comparable fastener, e.g., a metal rod and rivets, grommets, or washers.

Once a pin assembly, e.g. locking pin 400 or roll pin 600, is installed within the bat 100, the exterior sleeve 200 is applied to the bat 100. In the preferred embodiment, the exterior sleeve 200 is a rubber elastomer, being an elongated cone-shaped tube of about 1½ to 3½ inches in length and having an exterior surface 202, an interior surface 204, a top opening 208 and a bottom opening 210. Similar to the interior sleeve 300, the exterior sleeve 200 tapers from the top opening 208 to the bottom opening 210 resulting in the top opening 208 having a diameter greater than the bottom opening 210. The contour of the interior surface 204 of the exterior sleeve 200 is approximate to the contour of the exterior surface of the seam 502 and the transition 106 between the wood barrel portion 102 and the metal handle portion 110, which in the preferred embodiment is generally "hour glass" shaped having an indent 206 at the position of the seam 502. The exterior surface 202 is generally smooth and straight in shape. Also in the preferred embodiment, the exterior sleeve 200 is preferably made of a hard, durable rubber, e.g., a urethane 60 such as liquid Flexane commercially available by Devcon.

In operation, the metal/wood bat 100 is inserted through the exterior sleeve 200, knob end 112 first through the top opening 208, such that the top opening 208 is in contact with the wood barrel portion 102, the bottom opening 210 is in contact with the metal handle portion 110, and the seam 502 between the wood barrel portion 102 and the metal handle portion 110 is about centered at the dent 206 in the interior surface 204 of the exterior sleeve 200. The exterior sleeve 200 must be long enough in length such that it covers and extends beyond the pin assembly, e.g., the locking pin 400 or roll pin 600.

All dimensions and materials used in the preferred embodiment are for convenience purpose only. It would be readily apparent to one of ordinary skill in the relevant arts to design and build a bat and connection assembly of the present invention using different dimensions, e.g., for a junior size bat, a softball bat, or a standard adult size bat, and to use comparable materials and means for securing the bat together.

Conclusion

While various embodiments of the present invention have been described above, it should be understood that they have been presented by the way of example only, and not limitation. It will be understood by those skilled in the art that various changes in form and details may be made therein without departing from the spirit and scope of the invention as defined. Thus, the breadth and scope of the present invention should not be limited by any of the above-described exemplary embodiments.

I claim:

1. A method for manufacturing a bat, comprising the steps of:

(a) inserting a fitting portion of a wood barrel portion into a barrel receiving end of a metal handle portion, thereby creating a seam between said wood barrel portion and said metal handle portion of the bat;

(b) boring a hole through said metal handle portion and said fitting portion of said wood barrel portion, said hole being traverse to a longitudinal axis of the bat;

(c) inserting a pin into said hole; and (d) securing said pin in said hole, wherein said pin is a locking pin having a male component and a female component such that said securing said pin of said step (d) comprises inserting said male component into said female component.

2. A method for manufacturing a bat, comprising the steps of:

(a) inserting a fitting portion of a wood barrel portion into a barrel receiving end of a metal handle portion, thereby creating a seam between said wood barrel portion and said metal handle portion of the bat;

(b) boring a hole through said metal handle portion and said fitting portion of said wood barrel portion, said hole being traverse to a longitudinal axis of the bat;

(c) inserting a pin into said hole; and (d) securing said pin in said hole, wherein said pin is a roll pin and said step (d) comprises inserting a first fastener in a first end of said hole and inserting a second fastener in a second end of said hole.

3. The method according to claim 2, wherein said fastener is selected from the group consisting of threaded cap screws, rivets, grommets, and washers.

4. A method for manufacturing a bat, comprising the steps of:

(a) inserting a fitting portion of a wood barrel portion into a barrel receiving end of a metal handle portion, thereby creating a seam between said wood barrel portion and said metal handle portion of the bat;

(b) boring a hole through said metal handle portion and said fitting portion of said wood barrel portion, said hole being traverse to a longitudinal axis of the bat;

(c) inserting a pin into said hole; and (d) securing said pin in said hole, wherein said step (d) comprises tack welding at least one end of said pin.

5. A method for manufacturing a bat, comprising the steps of:

(a) inserting a fitting portion of a wood barrel portion into a barrel receiving end of a metal handle portion, thereby creating a seam between said wood barrel portion and said metal handle portion of the bat;

(b) boring a hole through said metal handle portion and said fitting portion of said wood barrel portion, said hole being traverse to a longitudinal axis of the bat;

(c) inserting a pin into said hole;

(d) securing said pin in said hole; and (e) fitting an exterior sleeve over the bat, said exterior sleeve being an elongated tube having a top opening and a bottom opening, such that said top opening is in contact with said wood barrel portion of the bat and said bottom opening is in contact with said metal handle portion of the bat.

6. The method according to claim 5, wherein said step (e) fits said exterior sleeve over the bat such that said seam is about centered in said exterior sleeve.

7. The method according to claim 5, wherein an interior surface of said exterior sleeve approximates the exterior surface of the bat at said seam.

8. The method according to claim 7, wherein said interior surface is generally hour-glass shaped.

9. The method according to claim 5, wherein said exterior sleeve is made of a hard rubber.

10. The method according to claim 5, wherein said exterior sleeve has a length within the range of about 1.5 inches to about 3.5 inches.

11. A method for manufacturing a bat, comprising the steps of:

(a) inserting a fitting portion of a wood barrel portion into a barrel receiving end of a metal handle portion, thereby creating a seam between said wood barrel portion and said metal handle portion of the bat;

(b) boring a hole through said metal handle portion and said fitting portion of said wood barrel portion, said hole being traverse to a longitudinal axis of the bat, wherein said hole is in proximity to said seam;

(c) inserting a pin into said hole; and (d) securing said pin in said hole.

12. The method according to claim 11, wherein said wood barrel portion has a transition between a hitting portion and said fitting portion, said transition being a smooth and gradual taper.

13. The method according to claim 12, wherein said transition is about a 45 degree slope.

14. The method according to claim 11, wherein said pin has a length equal to about a length of said hole.

15. The method according to claim 11, wherein said metal handle portion is hollow.

16. The method of claim 11, wherein said pin is selected from the group consisting of: a roll pin, a locking pin, and a locking pin having a male component and a female component.

17. A method for manufacturing a bat, comprising the steps of:

(a) inserting a fitting portion of a wood barrel portion into a barrel receiving end of a metal handle portion, thereby creating a seam between said wood barrel portion and said metal handle portion of the bat;

(b) boring a hole through said metal handle portion and said fitting portion of said wood barrel portion, said hole being traverse to a longitudinal axis of the bat;

(c) inserting a pin into said hole;

(d) securing said pin in said hole; and (e) positioning an interior sleeve over said fitting portion of said wood barrel portion prior to said step (a) such that said fitting portion with said interior sleeve are inserted within said barrel receiving portion of said metal handle portion.

18. The method according to claim 17, wherein said interior sleeve is a material selected from the group consisting of about 40 durometer gum rubber and tacky gum rubber.

19. The method according to claim 17, wherein said interior sleeve is an elongated tapered tube having a length about equal to a length of said fitting portion of said wooden barrel portion.

20. The method according to claim 17 wherein a top opening of said interior sleeve is slightly below said seam.

21. A method for manufacturing a bat, comprising the steps of:

(a) inserting a fitting portion of a wood barrel portion into a barrel receiving end of a metal handle portion, thereby creating a seam between said wood barrel portion and said metal handle portion of the bat;

(b) boring a hole through said metal handle portion and said fitting portion of said wood barrel portion, said hole being traverse to a longitudinal axis of the bat and about one half an inch below said seam;

(c) inserting a pin into said hole; and (d) securing said pin in said hole.

22. The method according to claim 21, wherein said metal handle portion is hollow.

23. The method according to claim 21, wherein said wood barrel portion has a transition between a hitting portion and said fitting portion, said transition being a smooth and gradual taper.

24. The method according to claim 23, wherein said transition is about a 45 degree slope.

25. The method according to claim 21, wherein said pin has a length equal to about a length of said hole.

26. The method according to claim 21, wherein said pin is selected from the group consisting of: a roll pin, a locking pin, and a locking pin having a male component and a female component.

* * * * *